US006241644B1

(12) United States Patent
Tepperberg

(10) Patent No.: US 6,241,644 B1
(45) **Date of Patent: *Jun. 5, 2001**

(54) FLEXIBLE EXERCISE DEVICE FOR CONTINUOUSLY INCREASED TENSION

(76) Inventor: Phillip S. Tepperberg, Box 521, Earleton, FL (US) 32631

( * ) Notice: Subject to any disclaimer, the term of this patent is extended or adjusted under 35 U.S.C. 154(b) by 0 days.

This patent is subject to a terminal disclaimer.

(21) Appl. No.: 09/557,900

(22) Filed: Apr. 21, 2000

Related U.S. Application Data

(63) Continuation of application No. 09/256,699, filed on Feb. 24, 1999, now Pat. No. 6,071,218.

(51) Int. Cl.[7] ..... A63B 21/02

(52) U.S. Cl. ..... 482/121; 482/122; 482/148; 482/907

(58) Field of Search ..... 482/121, 122, 482/125, 126, 135, 137, 143, 146, 148, 903, 91, 907

(56) References Cited

U.S. PATENT DOCUMENTS 6,071,218 * 6/2000 Tepperberg ..... 482/121

* cited by examiner

*Primary Examiner*—Jerome W. Donnelly
*Assistant Examiner*—Lori Baker Amerson
(74) *Attorney, Agent, or Firm*—Alvin S. Blum

(57) ABSTRACT

A stretch exercise device is molded in one piece of a material having the physical properties of a soft, flexible, deformable rubber. Two elongate, spaced apart side members extend along a long axis. Many finger grips or rungs are arranged parallel to one another attached at their ends to the side members. The rungs are spaced apart by a distance small enough so that a hand grasping a first rung may reach out with some fingers to reach an adjacent rung without first releasing a secure grip on the first rung. This enables a user to exert continuously increasing tension in stretching exercises. Grooves on the rungs and grooves on the side members provide finger gripping surfaces to facilitate this progressive tensioning movement.

7 Claims, 3 Drawing Sheets

FLEXIBLE EXERCISE DEVICE FOR CONTINUOUSLY INCREASED TENSION

This is a continuation of patent application 09/256,699, filed Feb. 24, 1999 now U.S. Pat. No. 6,071,218.

BACKGROUND OF THE INVENTION

This invention relates to exercise devices and, more particularly, to a flexible device to be grasped by the hand or hands for applying gradually increasing tension in stretching exercises.

Tensioning devices of the prior art for use in stretching exercises generally provide a spring or elastic elongate element with handles at opposite ends. The length may be adjusted to change the tension, but not during the actual stretching exercise. In stretching, greater benefit may come from greater tension. However, if this is applied suddenly, it may lead to discomfort or injury. If devices of the prior art are lengthened to reduce the threat of injury, the tension may not be great enough to achieve maximum benefit. If the length between handles is shortened to increase tension, the sudden application of great tension may cause injury.

SUMMARY OF THE INVENTION

It is, accordingly, an object of the invention to Provide a flexible exercise device that has handles that can be grasped to apply tension to the arms, in which the tension can be gradually increased by moving the hands closer together by moving a hand from one handle to a closer handle without ever releasing the hand's grasp on the device.

The device of the invention comprises a pair of spaced apart elongate side members with a plurality of spaced apart handles or rungs joined at their ends to side members.

The surfaces of the rungs and the side members are provided with corrugations or indentations that enable the fingers of the hand grasping a rung to move the hand along from the rung, along a side member and onto an adjacent rung without ever releasing the grip on the device. By this means tension on the arm may be continuously increased during an exercise without the dangers inherent in an abrupt tension increase.

DETAILED DESCRIPTION OF PREFERRED EMBODIMENTS

Figure 1:
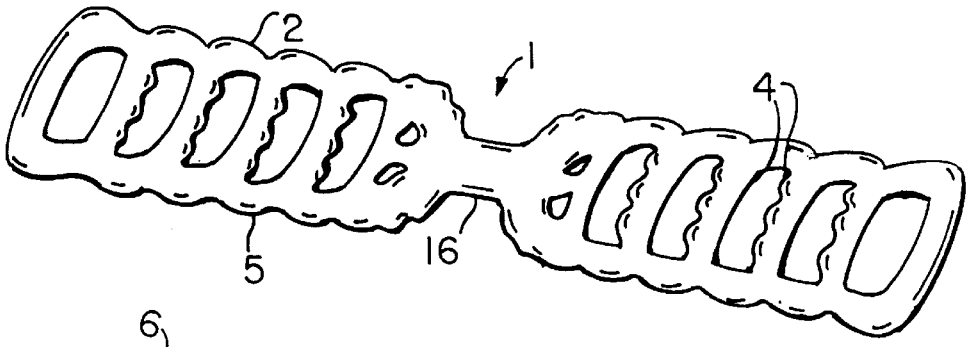
FIG. 1 is a perspective view of a device of the invention generated by computer with shading.
Figure 2:
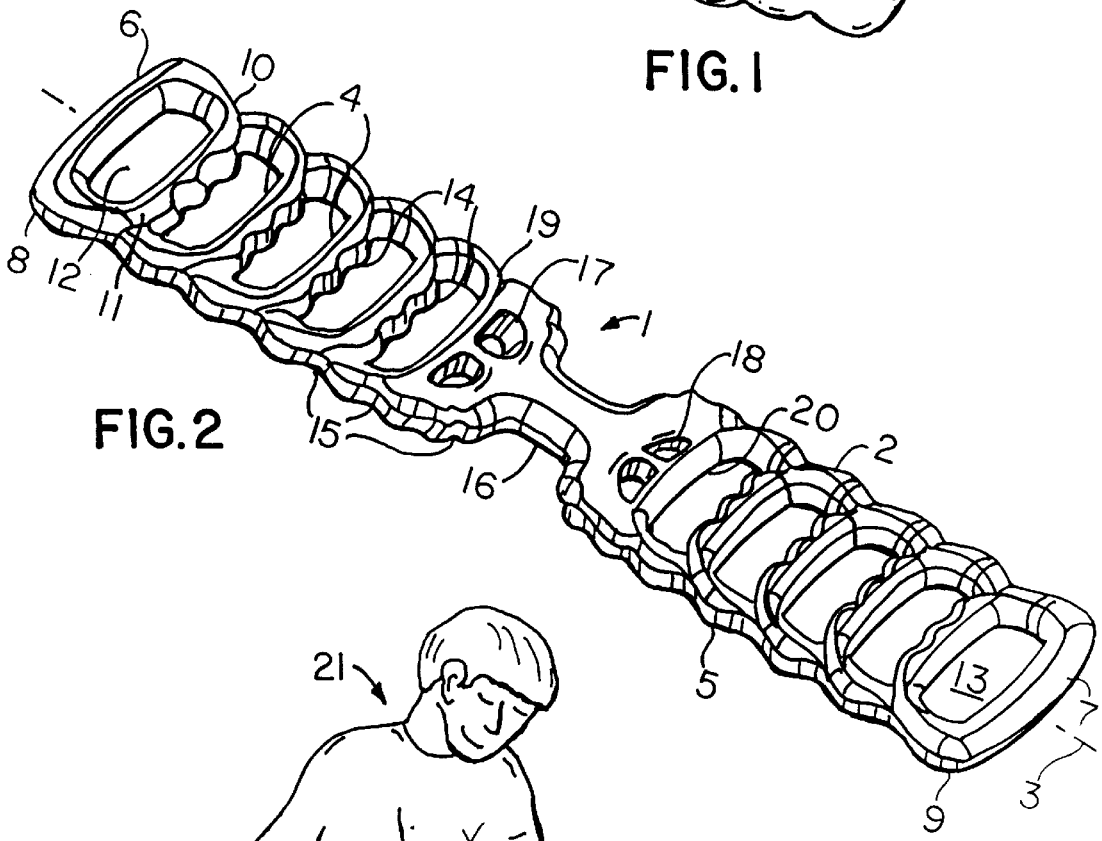
FIG. 2 is another perspective view of the device of FIG. 1 generated by computer with surface lines.
Figure 11:
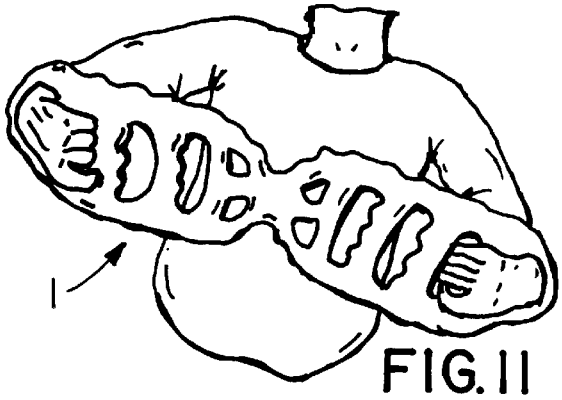
FIG. 11 shows diagrammatically the device in use at a user's back.

Referring now first to FIGS. 1 and 2, the invention comprises a one piece flexible, deformable exercise device for grasping with one or both hands during stretching exercises in many different positions. The device 1 comprises first elongate side member 2 and second elongate side member 5 spaced apart from one another and extending along long axis 3. A plurality of parallel, spaced apart solid hand grips or rungs 4 are connected at a first end 10 to first side member 2 and at a second end 11 to second side member 5. A first rung 6 at a first termination 8 of the side members and a last rung 7 at a second termination 9 of the side members are spaced apart from their adjacent rungs by spaces 12, 13 large enough to permit passage of a hand therethrough so as to permit certain exercises such as shown in FIG. 11 where the device is applied to the user's back. It is important that the shape of the device and the material of construction be such as to not injure the user in maneuvers such as that shown in FIG. 11. The device is preferably formed or molded in one piece from a soft resilient, deformable material having the physical properties of rubber. Silicone rubber, polyurethane rubber or thermoplastic elastomers are preferred materials of construction. At the midpoint, the side members converge to form a grasping region 16 at which the hands of a user may substantially meet. A first stalk 17 and a second stalk 18 extend in opposite directions toward the terminations. A first grasping element 19 and a second grasping element 20 are attached to the stalks. The surface of the rungs are provided with grooves 14 to enhance gripping action of the user's fingers. In like fashion, the surface of the side members is provided with grooves 15 to facilitate gripping with the fingers when the arms are pulling against the device in stretching exercises.

Figure 3:
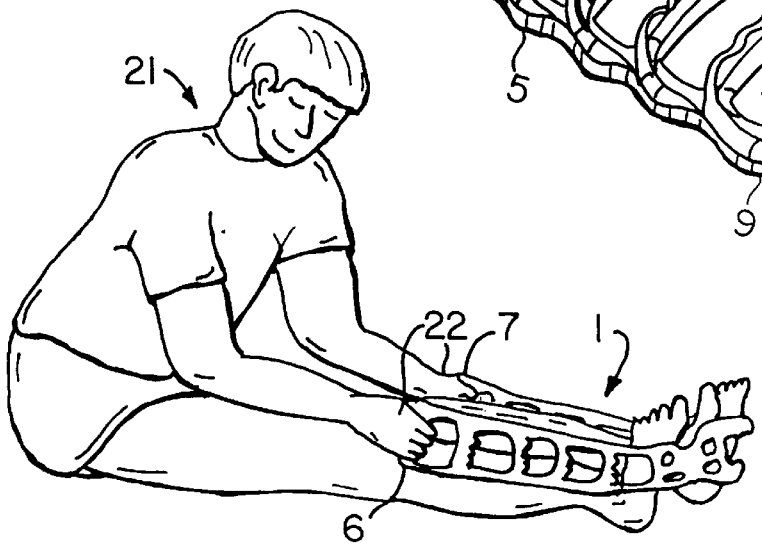
FIG. 3 is a perspective view of the invention in use at the start of a stretching exercise.
Figure 4:
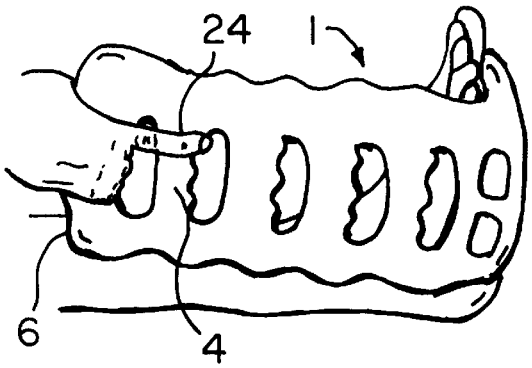
FIGS. 4–8 show diagrammatically how the hand moves along the device from the position in FIG. 3 to progressively increase tension without releasing a grip on the device.
Figure 5:
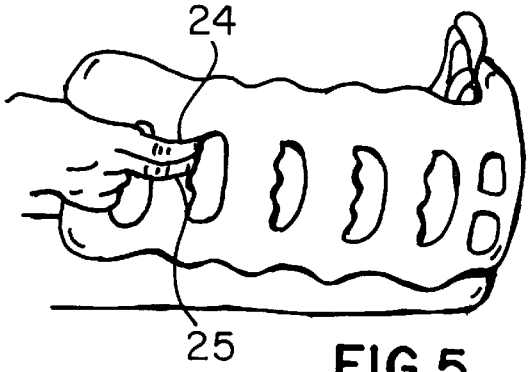
Figure 7:
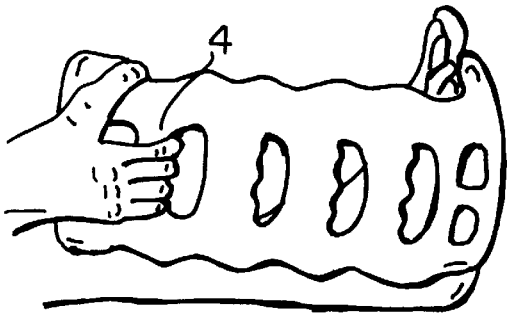
Figure 6:
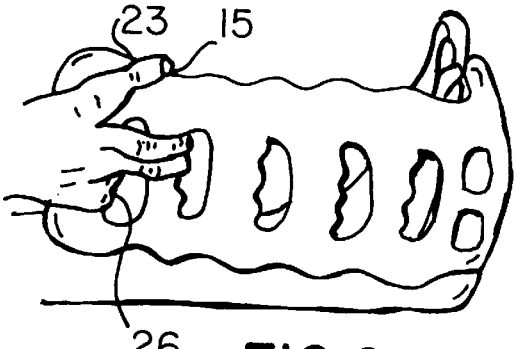

Referring now to FIGS. 3–10, a user 21 is shown in one of the very many positions in which the exercise device 1 of the invention may be employed to progressively and continuously stretch the muscles with greatly reduced danger of injury from the sudden application of force. Furthermore, the extent of stretching may be greatly increased over other stretching devices because the force is applied slowly and at a pace determined by the user. As shown in FIG. 3, the user 21 has grasped the first rung 6 and last rung 7 with hands 22 to put minimal tension on the arms. While maintaining a first grasp on the first rung 6, the index finger 24 is extended to the next rung 4 (FIG. 4). A second finger 25 is then advanced and both these fingers curl around the rung (FIG. 5). The thumb 23 is then moved into a groove 15 on the side member so that the device is held firmly enough (FIG. 6) that the last two fingers 26 may be released from the first rung and moved up to rung 4 (FIG. 7). As clearly shown in the drawings, the spaced apart relation between the side members and the rungs is maintained during the increasing tension so that the next rung may be readily grasped.

Figure 8:
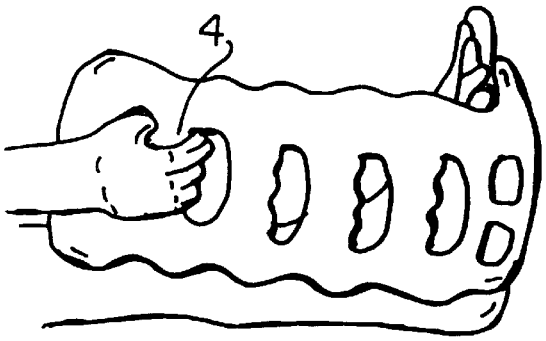
Figure 9:
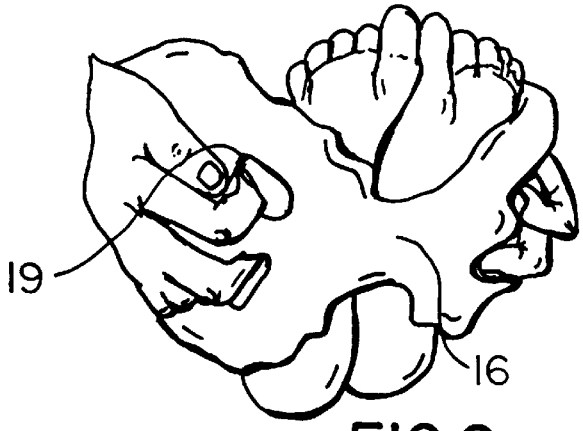
FIGS. 9,10 show diagrammatically reaching the ultimate stretch position wherein the two hands meet.
Figure 10:
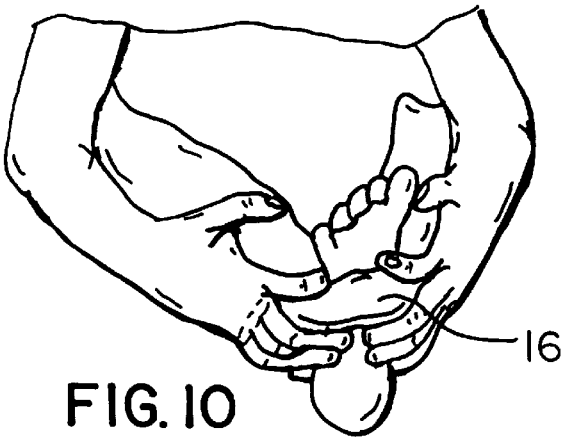

The thumb may now be curled around rung 4 (FIG. 8). The process may now be repeated to advance the hand along to the next rung and each rung in succession until the maximum tension and stretching that is desired is reached or the final hand positions are reached at FIG. 9 grasping the first grasping element 19 and then grasping the outer surfaces of the convergence region 16 (FIG. 10) where both hands substantially meet. The convergence region 16 may be forcefully pressed against the foot or other object. Because fingers could not be curled around a rung pressed against an object, a rung is not provided at this region. Instead the side members converge and fuse together with grooves along the outside. The dimensions of region 16 are small enough that the outside may be grasped with hands to provide a secure grip for this final stage as illustrated in FIG. 10.

The device may be employed in many maneuvers and exercises using one or both hands. A foot may be inserted into one space and one or both hands used to pull against the foot. One end of the device may be held by a stationary object, or the device may be looped around a stationary object. Because the device is molded of a soft rubber or rubber-like material that is flexible, resilient and deformable, it is less likely to injure the user when considerable tension is applied.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A flexible exercise device for grasping by an exercising user comprising:

A) first and second elongate side members extending side by side along a long axis;

B) a plurality of spaced apart solid rungs maintained disposed transverse to the long axis and substantially parallel to one another, each rung attached at a first end to the first member and attached at a second end to the second member, a first of the rungs located at a first termination of the first and second members and a last of the rungs located at a second termination of the members, the rungs and the members maintained in spaced apart relation; and C) the surfaces of the rungs and the members provided with finger engaging grooves for enabling a hand grasping a rung to maintain a grip on the device while moving the hand under tension from one rung, along a member, and then to adjacent rung to increase tension gradually by advancing along the long axis.

2. The exercise device according to claim 1 that has been molded in one piece from material having the elastic properties of rubber.

3. The exercise device according to claim 2 in which spaces are provided between the first rung and an adjacent rung and between the last rung and an adjacent rung that are large enough to permit passage therethrough of a hand.

4. A device for grasping by fingers of at least one hand to provide progressively increasing continuous tension to an exercising user, the device comprising:

A) flexible first and second elongate side members extending side by side along a long axis, each member having first and second terminations;

B) a plurality of hand grips disposed transverse to the long axis and substantially parallel to one another, each grip attached at a first end thereof to the first member, and at a second end thereof attached to the second member, the grips maintained in spaced apart relation;

C) a first of the grips located at the first termination of the members, and a last of the grips located at the last termination of the members; and D) a plurality of grips located between the first and last grips, and being spaced apart from one another by distances sufficiently small that a hand can move from one grip to an adjacent grip without losing a hold on the device.

5. The device according to claim 4 that has been molded in one piece from material having the elastic properties of rubber.

6. The device according to claim 5 in which the surfaces of the grips and members are provided with finger engaging grooves.

7. The device according to claim 4 in which the surfaces of the grips and members are provided with finger engaging grooves.

* * * * *